US012539945B2

(12) United States Patent
Bargende

(10) Patent No.: US 12,539,945 B2
(45) Date of Patent: Feb. 3, 2026

(54) DRIVE DEVICE AND FIN STABILIZER

(71) Applicant: SKF MARINE GMBH, Hamburg (DE)

(72) Inventor: Dirk Bargende, Elmshorn (DE)

(73) Assignee: SKF MARINE GMBH, Hamburg (DE)

( * ) Notice: Subject to any disclaimer, the term of this patent is extended or adjusted under 35 U.S.C. 154(b) by 362 days.

(21) Appl. No.: 18/012,407

(22) PCT Filed: Jul. 6, 2021

(86) PCT No.: PCT/EP2021/068681

§ 371 (c)(1),
(2) Date: Dec. 23, 2022

(87) PCT Pub. No.: WO2022/013015

PCT Pub. Date: Jan. 20, 2022

(65) Prior Publication Data

US 2023/0249786 A1 Aug. 10, 2023

(30) Foreign Application Priority Data

Jul. 14, 2020 (DE) ..... 10 2020 208 771.7

(51) Int. Cl.
*B63B 39/06* (2006.01)

(52) U.S. Cl.
CPC ..... *B63B 39/06* (2013.01); *B63B 2039/067* (2013.01)

(58) Field of Classification Search
CPC ..... B63B 39/06; B63B 2039/067; B63B 2039/065; B63B 39/061
See application file for complete search history.

(56) References Cited

U.S. PATENT DOCUMENTS 2,979,010 A 4/1961 Braddon et al.
3,456,612 A 7/1969 Rieprich
3,924,555 A * 12/1975 Napolitano ..... B63B 39/06 114/126

(Continued)

FOREIGN PATENT DOCUMENTS

DE 1267127 B 4/1968
EP 2988992 B1 * 3/2017 ..... B63B 39/06

(Continued)

OTHER PUBLICATIONS

International Search Report and Written Opinion dispatched Jan. 20, 2022 for parent application No. PCT/EP2021/068681.

(Continued)

*Primary Examiner* — Eldon T Brockman
(74) *Attorney, Agent, or Firm* — J-TEK LAW PLLC; Scott T. Wakeman; Mark A. Ussai

(57) ABSTRACT

A drive device of a fin stabilizer is for pivoting a stabilizer fin about its fin shaft axis. The drive device includes a drive motor with an output shaft and a transmission including an input shaft. A fixing device for fixing the stabilizer fin in a pivot position acts directly on the transmission input shaft. A coupling is for conjoint-rotation connection of the transmission input shaft to the motor output shaft disposed at least sectionally in an interior of the motor output shaft. The coupling is connected to a free end of the transmission input shaft and has a flange connected to an annular end surface of the motor output shaft.

7 Claims, 1 Drawing Sheet

(56) References Cited

U.S. PATENT DOCUMENTS

| | | | | |
|---|---|---|---|---|
| 4,273,063 | A * | 6/1981 | Berne | B63B 39/06 92/113 |
| 10,625,831 | B2 * | 4/2020 | Venables | B63J 99/00 |
| 11,198,492 | B2 * | 12/2021 | Cappiello | B63B 39/06 |
| 11,685,485 | B2 * | 6/2023 | Venables | B63B 39/06 114/126 |
| 2005/0090364 | A1 | 4/2005 | Lee et al. | |
| 2010/0083887 | A1 * | 4/2010 | Cappiello | B63B 39/061 114/126 |
| 2016/0121978 | A1 | 5/2016 | Venables et al. | |
| 2020/0377182 | A1 * | 12/2020 | Cappiello | B63B 39/06 |

FOREIGN PATENT DOCUMENTS

| | | | |
|---|---|---|---|
| GB | 802105 | A | 10/1958 |
| JP | 2008308054 | A | 12/2008 |
| WO | 2019021094 | A1 | 1/2019 |

OTHER PUBLICATIONS

Office Action from the German Patent Office dispatched Mar. 30, 2021 in related German application No. 10 2020 208 771.7, and translation thereof.

Office Action and Search Report from the Chinese Patent Office dispatched May 28, 2025 in related application No. 202180045173.3, and translation thereof.

* cited by examiner

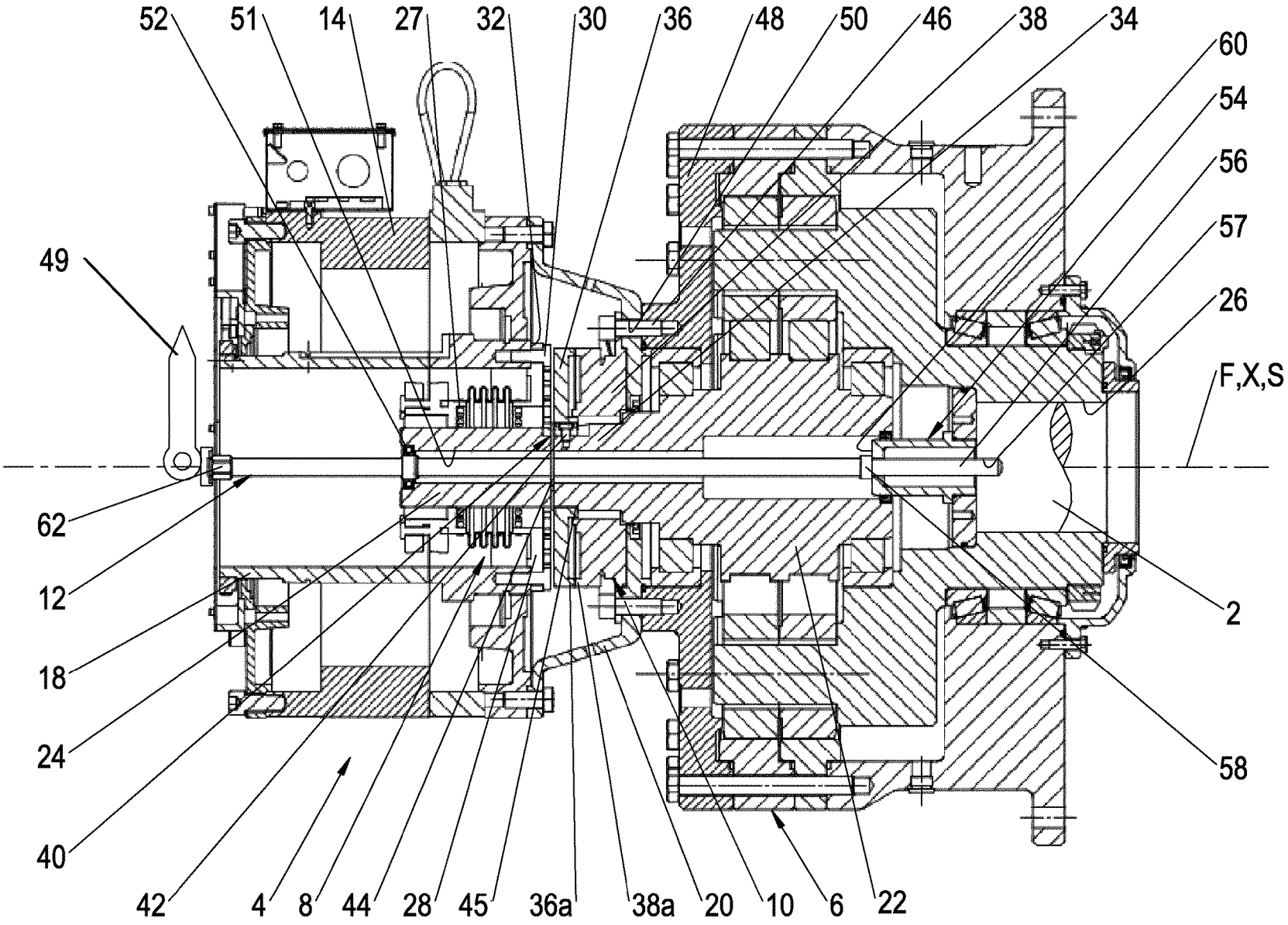
60
54
56
57
26
F,X,S
2
58
34
38
46
50
48
36
30
32
27
14
51
52
49
62
12
18
24
40
42
4
8
44
28
45
36a
38a
20
10
6
22

DRIVE DEVICE AND FIN STABILIZER

CROSS-REFERENCE

This application is the U.S. National Stage of International Application No. PCT/EP2021/068681 filed on Jul. 6, 2021, which claims priority to German patent application no. 10 2020 208 771.7 filed on Jul. 14, 2020.

BACKGROUND OF THE INVENTION

The present invention relates to a drive device of a fin stabilizer for pivoting a stabilizer fin about its fin shaft axis, and a fin stabilizer.

Fin stabilizers in ships usually include hydraulic drives for pivoting the stabilizer fin about its fin shaft axis. Using hydraulic drives, large torques can be generated that are necessary in order to pivot the stabilizer fin. For fixing the stabilizer fin in a pivot position, fixing devices are provided that act directly on the fin and thus lock it. Exemplary prior art is shown in WO 2019/021094 A1 and GB 802 105 A.

SUMMARY OF THE INVENTION

An object of the present invention is to provide a drive device of a fin stabilizer for pivoting a stabilizer fin about its fin shaft axis, which makes possible a load-reduced fixing of the stabilizer fin in a pivot position. In addition, it is an object of the invention to provide a fin stabilizer that makes possible a load-reduced fixing of the stabilizer fin in a pivot position.

An inventive drive device of a fin stabilizer for the pivoting of a stabilizer fin about its fin shaft axis has a drive motor and a transmission. The drive motor is coupled by its motor output shaft to a transmission input shaft. The transmission has a recess for receiving the fin shaft such that the transmission and the fin shaft rotate together. The drive device also has a fixing device for fixing the stabilizer fin in a pivot position; the fixing device acts directly on the transmission input shaft. The drive device is embodied compact and thus space-saving as a coupling for the connecting of the transmission input shaft to the motor output shaft, such that they rotate together, is disposed at least sectionally in a cavity of the motor output shaft. The cavity can only be formed on the end face, or in order to save weight and material, axially penetrate the entire motor output shaft, so that the motor output shaft is embodied as a hollow shaft. The coupling is, for example, a metal bellows coupling. The coupling sits directly on a shaft end of the transmission input shaft protruding into the cavity of the motor output shaft and is connected to the shaft end of the transmission input shaft. In addition, it is connected via a flange to an annular end surface of the motor output shaft, or screwed thereto. The flow of forces thereby forms radially from outward to inward, starting from the motor output shaft toward the transmission input shaft. The coupling is clamped, for example, by a tapered interference fit onto the transmission input shaft. Other types of connections, such as, for example, classical feather key/keyway connections are also conceivable.

The fixing device allows the use of a non-self-locking drive motor. The transmission allows the changing, and in particular the reducing, of a motor rotational speed, and the increase of a motor rotational torque. The drive motor is preferably an electric motor, in particular a synchronous motor. Electric motors have a technically simple construction, are compactly realizable, nearly maintenance-free, and simple to control. In addition, they do not have leakages that usually occur in hydraulic drives, such as hydraulic rotary vane drives. The transmission is preferably an eccentric transmission, in particular a cycloidal transmission. However, other types of transmission are also conceivable. With the inventive drive device, viewed from the drive motor outward the fixing device is disposed in front of a transmission, and thus does not directly interact with the fin shaft, but rather via the transmission. The fixing device thus sits between the drive motor and the transmission, so that a fixing of the stabilizer fin, or locking, generated by the fixing device does not act on the torque on the fin shaft, but rather only the on the smaller transmission-input-shaft-side motor torque. In addition, the translation ratio is influenced by the transmission, so that the locking can be set in very fine angular steps. For example, the locking can be undertaken in 10° steps. If the transmission has a translation ratio of 1:45, the stabilizer fin can be fixed in 10°/45=0.22° steps.

In one embodiment the fixing device is currentlessly biased in the locking direction. The cancellation of the locking, and thus the overcoming of the mechanically generated locking force, is effected via an electrically generated release force. In other words, in this embodiment the locking device is locked (closed) in a currentless manner. The cancellation of the locking is effected electromagnetically. A low-energy locking is ensured by the mechanical locking force and the electrically generated release or counter force. In addition, it is ensured that in the unlikely case of a power failure, the fixing device is automatically locked and thus fixes the stabilizer fin, since the release force is cancelled. The mechanical locking force is effected, for example, via at least one compression spring. The release force is generated, for example, via at least one electromagnet, and is then a magnetic force.

The coupling preferably sits directly on a shaft end of the transmission input shaft protruding into the cavity of the motor output shaft and is connected to the shaft end of the transmission input shaft. In addition, it is connected via a flange to an annular end surface of the motor output shaft, or screwed thereto. The flow of forces thereby forms radially from outward to inward, starting from the motor output shaft toward the transmission input shaft. The coupling is clamped, for example, by a tapered interference fit onto the transmission input shaft. Other types of connections, such as, for example, classical feather key/keyway connections are also conceivable.

For the axial securing of the fin shaft in the receptacle or transmission receptacle, one embodiment provides a securing element that extends along the pivot axis and is connected by an end section to the fin shaft such that they rotate together. The securing element is preferably an elongated element, such as a rotationally symmetric rod or a pipe. The connection to the fin shaft can be effected via a thread engagement or an alternative interference-fit connection, which on the one hand allows the separation from the fin shaft, and on the other hand allows the transmission of the rotation of the fin shaft to the securing element.

On another end section, the securing element can include a receptacle for arranging an indicator element for indicating a pivot angle of the stabilizer fin, so that in a purely mechanical manner the respective pivot position of the stabilizer fin is displayed in a visual manner. Due to the purely mechanical embodiment and the extension of the securing element along the pivot axis, expensive device-technology constructions can be omitted, since the pivot position of the fin shaft is transmitted 1:1, i.e., without increasing or decreasing speed by translation, to the indicator element.

The securing element is preferably supported in the transmission input shaft. Due to this measure the securing element requires no additional installation space.

An inventive fin stabilizer includes an inventive drive device. Such a fin stabilizer makes possible a low-load fixing of its stabilizer fin in nearly any pivot position.

Other advantageous embodiments of the invention are the subject matter of further dependent claims.

BRIEF DESCRIPTION OF THE SEVERAL VIEWS OF THE DRAWINGS

In the following a preferred exemplary embodiment of the invention is explained in more detail with reference to a greatly simplified schematic FIGURE. The sole FIG. 1 shows a partial longitudinal section through an inventive drive device.

DETAILED DESCRIPTION OF THE INVENTION

In the following, directional or position indications used, such as radial, axial, radially inward, or radially outward, refer to a pivot axis S of the drive device.

FIG. 1 shows a longitudinal section through a preferred exemplary embodiment of the inventive drive device 1 of a fin stabilizer for pivoting a stabilizer fin about its fin shaft axis F. In the horizontal orientation of FIG. 1, the stabilizer fin not shown here is located to the right of the FIGURE edge and is connected to the drive device 1 via its fin shaft 2. The fin shaft 2 forms, by its longitudinal axis X, the fin shaft axis F that is the same as a pivot axis S of the drive device 1.

The drive device 1 has a drive motor 4, a transmission 6, a coupling 8, a fixing device 10, and a securing element 12.

In this exemplary embodiment the drive motor 4 is an electric motor, preferably a synchronous motor. It has a stator 14 and a rotor rotating in the stator, of which the rotor shaft 18 is shown in FIG. 1. In the following the rotor shaft 18 is also referred to as motor output shaft. The motor output shaft 18 is configured as a hollow shaft, and extends along the pivot axis S.

In this exemplary embodiment the transmission 6 is an eccentric transmission, and in particular a cycloidal transmission. It serves for changing the drive motor rotational speed, in particular for reducing the motor rotational speed, and for changing the motor torque, in particular for increasing the torque.

The transmission 6 is fixedly connected to the stator 14 of the drive motor 4 via a housing 20, such as a motor carrier or a motor flange. The transmission 6 includes a transmission input shaft 22 that extends along the pivot axis S and protrudes by its free, according to the illustration left, shaft end 24 into the motor output shaft 18. The transmission input shaft 22 interacts via a plurality of indicated and unnumbered transmission steps with an output-side transmission output shaft or carrier disc or carrier shaft 26 of the transmission 6. The fin shaft opening 26 also extends along the pivot axis S and, being on the output side of the transmission 6, is disposed opposite to the input-side free shaft end 24 of the transmission input shaft 6.

The coupling 8 serves for connecting the motor output shaft 18 to the transmission input shaft 22. In the exemplary embodiment shown here, the coupling is embodied as a metal bellows coupling. A tapered clamping set connects the coupling 8 to the free shaft end 24 in a friction-fit manner. Via a radially outer axially disposed flange 28 and suitable attachment means 30, the coupling is connected to an annular end surface 32 of the motor output shaft 18, in particular screwed.

The fixing device 10 serves for fixing the stabilizer fin in a pivot position. In the exemplary embodiment shown here, the fixing device 10 is a toothed holding brake and shown in its locked position.

The fixing device 10 is located between the drive motor 4 and the transmission 6 in the interior of the motor flange 20. It is disposed in the region of a shaft section 34 of the transmission input shaft 22, which shaft section 34 is adjacent to the free shaft 24, and thus, viewed axially, directly adjacent to the motor output shaft 18.

The fixing device 10 includes two toothed rings 36, 38 (first toothed ring 36, second toothed ring 38) that are aligned with one another and engage the transmission input shaft 22.

The first toothed ring 36 is rotatably connected to the transmission input shaft 22 and thus rotatable. In the exemplary embodiment shown, the connection for conjoint rotation is produced via a tongue and groove connection 40, whose tongue is screwed to the transmission input shaft 22 by a radial screw 42. In the axial direction the first toothed ring is positionally fixed via a spring ring 44 in a circumferential groove of the transmission input shaft 22 against an annular shoulder 45 thereof.

The second toothed ring 38 is supported on the transmission housing side. It is axially displaceably supported on a further, internal fixing device toothing and is pressed by spring force into the counter toothing of the toothed ring **36*a*. The fixing device housing is attached via screws 46 that extend by through bores 50 of the motor flange 20 so that the motor flange 20 is clamped between a base body carrying the second toothed ring 38 and the transmission housing 48**.

Both toothed rings 36, 38 have a plurality of radially outer, axially extending teeth **36*a*, 38*a* that are matched to one another and can engage one-into-another. In the locked position shown, the toothed rings 36, 38 including their teeth 36*a*, 38*a* are in operative engagement, so that the stabilizer fin is fixed in a pivot position. The teeth 36*a*, 38*a* of the toothed rings 36, 38** are preferably uniformly distributed, so that a multiple toothing is set with each locking.

The locking of the fixing device 10 is effected via a mechanical biasing or locking force that is applied via at least one not-shown compression spring. A plurality of compression springs are disposed radially about the pivot axis S, axially in the base body, and acting upon the second toothed ring 38 with an axial locking force toward the first toothed ring 36.

For releasing the locking, the fixing device 10 includes at least one not-shown electromagnet that is located in or on the base body. When energized, the at least one electromagnet generates an axial magnetic releasing force that is greater than the mechanical locking force (pressure-spring force), so that with energization of the electromagnet the second toothed ring 38 is pushed against the locking force axially away from the first toothed ring 36, and the multiple interlocking is released.

In the exemplary embodiment shown here, the securing element 12 has two functions. On the one hand it serves for axial securing of the fin shaft 2 in the fin shaft receptacle 26 of the transmission 6. On the other hand it serves for receiving an indicator instrument 49, preferably a mechanical pointer.

The securing element 12 extends along the pivot axis S and is configured here as a rotationally symmetric rod. The securing element 12 is guided through the motor output shaft 18 and through a longitudinal bore 51 of the transmission input shaft 22. The supporting of the securing element 12 is effected via a bearing 52, preferably a rolling-element bearing, in the longitudinal bore 51 in the region of the free shaft end 24 of the transmission input shaft 22, and in the screwed-in state via the fin shaft 2.

The securing element 12 penetrates an insert 54 that is disposed between the transmission input shaft 22 and the fin shaft receptacle 26, and protrudes by an external-thread end section for interacting with a corresponding end face internally threaded bore 57 of the fin shaft 2 into the fin shaft receptacle 26. A secure screw connection is achieved via a radial collar 58 of the securing element 12 that abuts axially against an end side 60 of the insert 54, which end side 6*o* faces away from the received fin shaft 2.

For receiving the indicator element 49, the securing element 12 includes a suitable receptacle 62 on its end section opposite to the external-thread end section. The indicator element 49 is, for example, a pointer which, in interaction with an angle indicator, allows the respective pivot angle of the stabilizer fin to be visualized.

Disclosed is a drive device of a fin stabilizer for pivoting a stabilizer fin about its fin shaft axis, including a drive motor and a transmission, wherein a fixing device for fixing the stabilizer fin in a pivot position acts directly on a transmission input shaft, and a fin stabilizer.

REFERENCE NUMBER LIST

1 Drive device
2 Fin shaft
4 Drive motor
6 Transmission
8 Coupling
10 Fixing device
12 Securing element
14 Stator
18 Rotor shaft/motor output shaft
20 Housing/motor carrier/motor flange
22 Transmission input shaft
24 Free shaft end
26 Fin shaft receptacle
27 Tapered clamping set
28 Flange
30 Attachment means
32 Annular end surface
34 Shaft section
36 First toothed ring (rotatable toothed ring)
36*a* Tooth
38 Second toothed ring (non-rotatable toothed ring)
38*a* Tooth
40 Tongue-groove connection
42 Radial screw
44 Spring ring
45 Ring shoulder
46 Screw
48 Transmission housing
49 Indicator element
50 Bore
51 Longitudinal bore
52 Bearing
54 Insert
56 External-thread end section
57 Internal-thread bore
58 Radial collar
60 End side
62 Receptacle
F Fin shaft axis
X Longitudinal axis
S Pivot axis

The invention claimed is:

1. A drive device of a fin stabilizer for pivoting a stabilizer fin about its fin shaft axis, the drive device comprising:

a drive motor including an output shaft, and a transmission (6) including an input shaft, the drive motor being coupled to the transmission input shaft by its motor output shaft, and the transmission having a receptacle for receiving the fin shaft such that they rotate together, a fixing device for fixing the stabilizer fin in a pivot position, the fixing device acting directly on the transmission input shaft, and a coupling for conjoint-rotation connection of the transmission input shaft to the motor output shaft disposed at least sectionally in an interior of the motor output shaft, the coupling being connected to a free shaft end of the transmission input shaft and having a flange connected to an annular end surface of the motor output shaft.

2. The drive device according to claim 1, wherein the fixing device is currentlessly biased in the locking direction, and the cancellation of the locking is affected by an electrically generated release force.

3. The drive device according to claim 1, wherein the fixing device has a first toothed ring that is connected to the transmission output shaft such that they rotate together, and includes a second, non-rotatable toothed ring that is aligned with the first toothed ring and is axially displaceable, wherein during locking the toothed rings are in engagement by their facing teeth.

4. The drive device according to claim 1, wherein a securing element extends along its pivot axis and is connected to the fin shaft by an end section such that the securing element and the fin shaft rotate together.

5. The drive device according to claim 4, wherein the securing element includes a receptacle on another end section, the receptacle receiving an indicator element for indicating a pivot angle of the stabilizer fin.

6. The drive device according to claim 4, wherein the securing element is supported in the transmission input shaft.

7. A fin stabilizer including a drive device according to claim 1.

* * * * *